US010697646B2

(12) United States Patent
Paller

(10) Patent No.: US 10,697,646 B2
(45) Date of Patent: Jun. 30, 2020

(54) EXHAUST GAS COLLECTION SYSTEM FOR A GAS BURNER ASSEMBLY

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 110 days.

(21) Appl. No.: 15/891,487

(22) Filed: Feb. 8, 2018

(65) Prior Publication Data

US 2019/0242591 A1 Aug. 8, 2019

(51) Int. Cl.

| | |
|---|---|
| ***F24C 15/00*** | (2006.01) |
| ***F24C 15/20*** | (2006.01) |
| ***F24C 3/08*** | (2006.01) |

(52) U.S. Cl.

CPC ..... *F24C 15/2042* (2013.01); *F24C 3/08* (2013.01)

(58) Field of Classification Search

CPC ..... F24C 15/00; F24C 15/001; F24C 15/002; F24C 15/20; F24C 153/085; F24C 15/006; F24C 15/32

See application file for complete search history.

(56) References Cited

U.S. PATENT DOCUMENTS 3,002,513 A 10/1961 Morasch
3,934,811 A * 1/1976 Perl ..... F24C 3/106 251/11
4,236,503 A * 12/1980 Kemp ..... F24C 15/10 126/214 D
4,750,470 A * 6/1988 Beach ..... F24C 15/2042 126/299 D
4,850,335 A * 7/1989 Farnsworth ..... F24C 3/085 126/299 R
5,044,352 A 9/1991 Lok
5,568,804 A * 10/1996 Joseph ..... F24C 3/067 126/39 H
6,132,205 A * 10/2000 Harneit ..... F23D 14/06 126/39 E
7,956,309 B2 * 6/2011 Kim ..... H05B 3/744 219/452.12
8,899,972 B2 * 12/2014 Fowler ..... F23D 14/06 126/39 E
9,138,098 B1 * 9/2015 Sun ..... F24C 15/107
(Continued)

FOREIGN PATENT DOCUMENTS

| | | |
|---|---|---|
| CN | 106287892 A | 1/2017 |
| CN | 206291268 U | 6/2017 |
| JP | 4060151 B2 | 3/2008 |

*Primary Examiner* — Gregory A Wilson
(74) *Attorney, Agent, or Firm* — Dority & Manning, P.A.

(57) ABSTRACT

An exhaust gas collection system for a gas burner assembly includes a plurality of concentric rings surrounding the gas burner assembly. Each concentric ring defines a support surface for supporting a cooking utensil, with the height of the support surfaces increasing further away from the gas burner assembly. The concentric rings define a plurality of plenums that are fluidly coupled with an exhaust fan for collecting and discharging exhaust gases. In this manner, the exhaust fan traps, collects, and discharges exhaust gases regardless of the size of cooking utensil being heated.

20 Claims, 6 Drawing Sheets

(56) References Cited

U.S. PATENT DOCUMENTS

| | | | | |
|---|---|---|---|---|
| 2004/0011350 | A1* | 1/2004 | Dowst | A47J 27/022 126/344 |
| 2012/0180779 | A1 | 7/2012 | Sun | |
| 2017/0227235 | A1 | 8/2017 | Best et al. | |
| 2019/0145626 | A1* | 5/2019 | Cadima | F23D 14/62 126/39 E |

* cited by examiner

EXHAUST GAS COLLECTION SYSTEM FOR A GAS BURNER ASSEMBLY

FIELD OF THE INVENTION

The present subject matter relates generally to gas burner assemblies, and more particularly, to exhaust gas collection systems for gas burner assemblies.

BACKGROUND OF THE INVENTION

Gas burners are commonly used on the cooktops of household gas cooking appliances including e.g., range ovens and cooktop appliances built into cabinetry. For example, gas cooktops traditionally have at least one gas burner positioned at a cooktop surface for use in heating or cooking an object, such as a cooking utensil and its contents. Gas burners generally include an orifice that directs a flow of gaseous fuel into a fuel chamber. Between the orifice and the fuel chamber, the gaseous fuel entrains air, and the gaseous fuel and air mix within the fuel chamber before being ignited and discharged out of the fuel chamber through a plurality of flame ports.

Conventional cooktop appliances include grates positioned over the gas burners such that cooking utensils may be positioned directly over the gas burners for heating. During operation, the gas burners generate heat by combusting fuel such that the heat, flames, and exhaust gases travel along a bottom of the cooking utensil, up the side of the cooking utensil, and exhaust to the environment. However, when cooking utensils are heated in this manner, handles positioned on the side of the cooking utensil become very hot, excessive heat is discharged into the kitchen, and items placed too close to the burner may even ignite, thereby presenting various safety concerns.

Certain cooktop appliances include exhaust gas collection systems which utilize an exhaust fan to collect hot exhaust gases. However, cooktop appliances using such systems frequently fail to heat the entire bottom of the cooking utensil, particularly when large utensils are used. In addition, such systems frequently require very large exhaust fans to capture large volumes of exhaust gases and ambient air.

Accordingly, a cooktop appliance including an improved exhaust gas collection system would be desirable. More particularly, an exhaust gas collection system for a gas burner assembly that effectively heats utensils of all sizes, collects hot gases associated with such heating, and uses a smaller exhaust fan would be particularly beneficial.

BRIEF DESCRIPTION OF THE INVENTION

The present disclosure relates generally to an exhaust gas collection system for a gas burner assembly including a plurality of concentric rings surrounding the gas burner assembly. Each concentric ring defines a support surface for supporting a cooking utensil, with the height of the support surfaces increasing further away from the gas burner assembly. The concentric rings define a plurality of plenums that are fluidly coupled with an exhaust fan for collecting and discharging exhaust gases. In this manner, the exhaust fan traps, collects, and discharges exhaust gases regardless of the size of cooking utensil being heated. Additional aspects and advantages of the invention will be set forth in part in the following description, or may be apparent from the description, or may be learned through practice of the invention.

In one exemplary embodiment, a cooktop appliance includes a top panel and a gas burner assembly positioned at the top panel and defining an axial direction. The gas burner assembly includes a cap and being configured for combusting a flow of gas and generating a flow of exhaust gas. An exhaust gas collection system includes a first support ring positioned around the gas burner assembly, the first support ring defining a first gas plenum and a first support surface that is positioned above the cap of the gas burner assembly along the axial direction. A second support ring is positioned around and spaced apart from the first support ring to define a second gas plenum, the second support ring defining a second support surface that is positioned above the first support surface along the axial direction. An exhaust fan is fluidly coupled to the first gas plenum and the second gas plenum for collecting the flow of exhaust gas.

In another exemplary embodiment, an exhaust gas collection system for a gas burner assembly is provided. The gas burner assembly being configured for combusting fuel to generate a flow of exhaust gas. The exhaust gas collection system includes a first support ring positioned around the gas burner assembly, the first support ring defining a first gas plenum and a first support surface that is positioned above a cap of the gas burner assembly along an axial direction. A second support ring is positioned around and spaced apart from the first support ring to define a second gas plenum, the second support ring defining a second support surface that is positioned above the first support surface along the axial direction. An exhaust fan is fluidly coupled to the first gas plenum and the second gas plenum for collecting the flow of exhaust gas.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
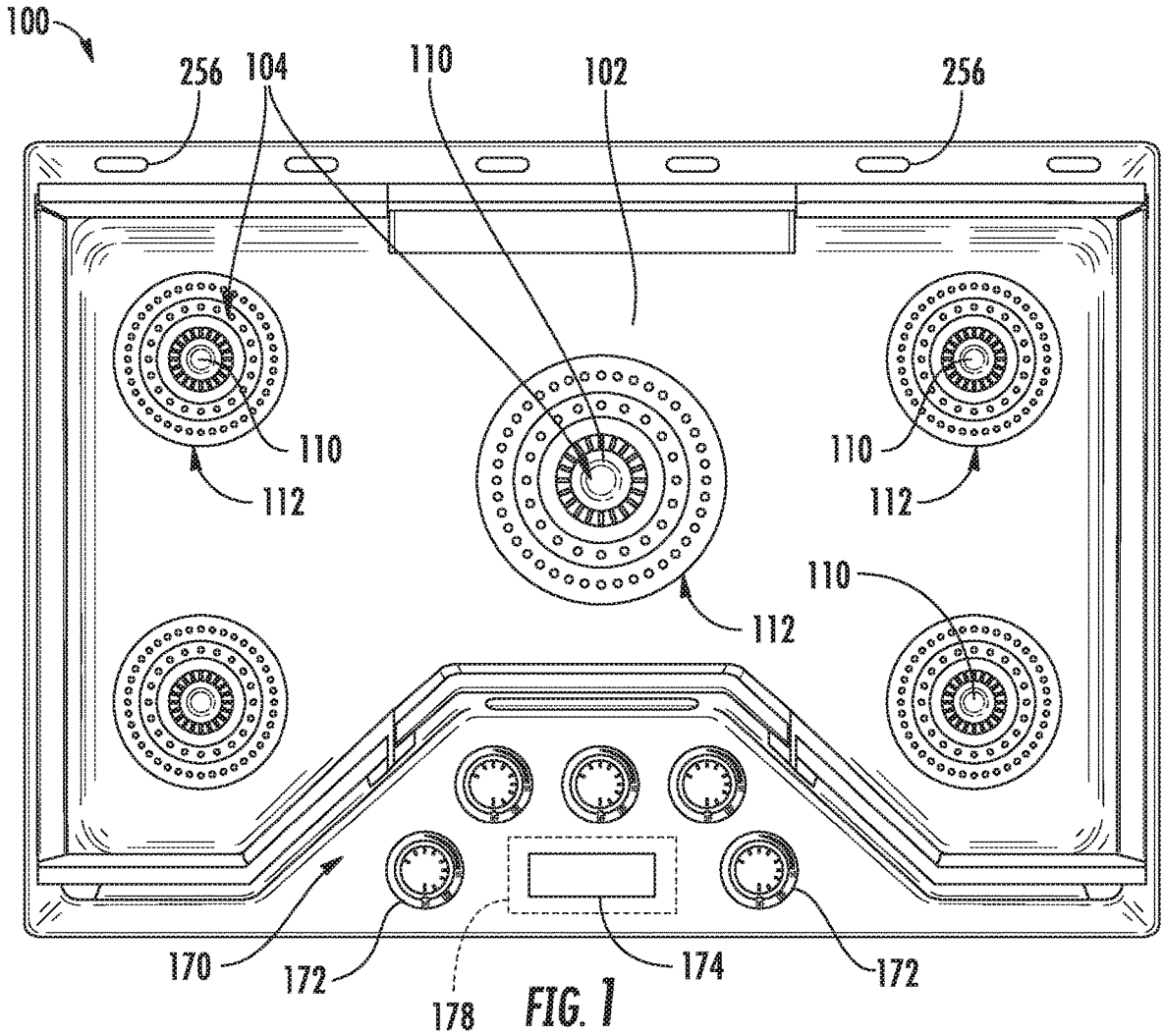
FIG. 1 provides a top view of a cooktop appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary gas burner assemblies described below may be used on other types of cooking appliances, such as ranges or oven appliances. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated embodiment, cooktop appliance 100 is a gas cooktop and heating elements 104 are gas burners, such as a gas burner assembly 110 described below. As illustrated, heating elements 104 are positioned within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more support members 112 configured to support a cooking utensil, such as a pot, pan, etc. In general, support members 112 permit the positioning of the cooking utensil over heating elements 104 such that heating elements 104 provide thermal energy to cooking utensils above top panel 102 by combustion of fuel below the cooking utensils. As explained in detail below, support members 112 may be part of an exhaust gas collection system 200.

Figure 2:
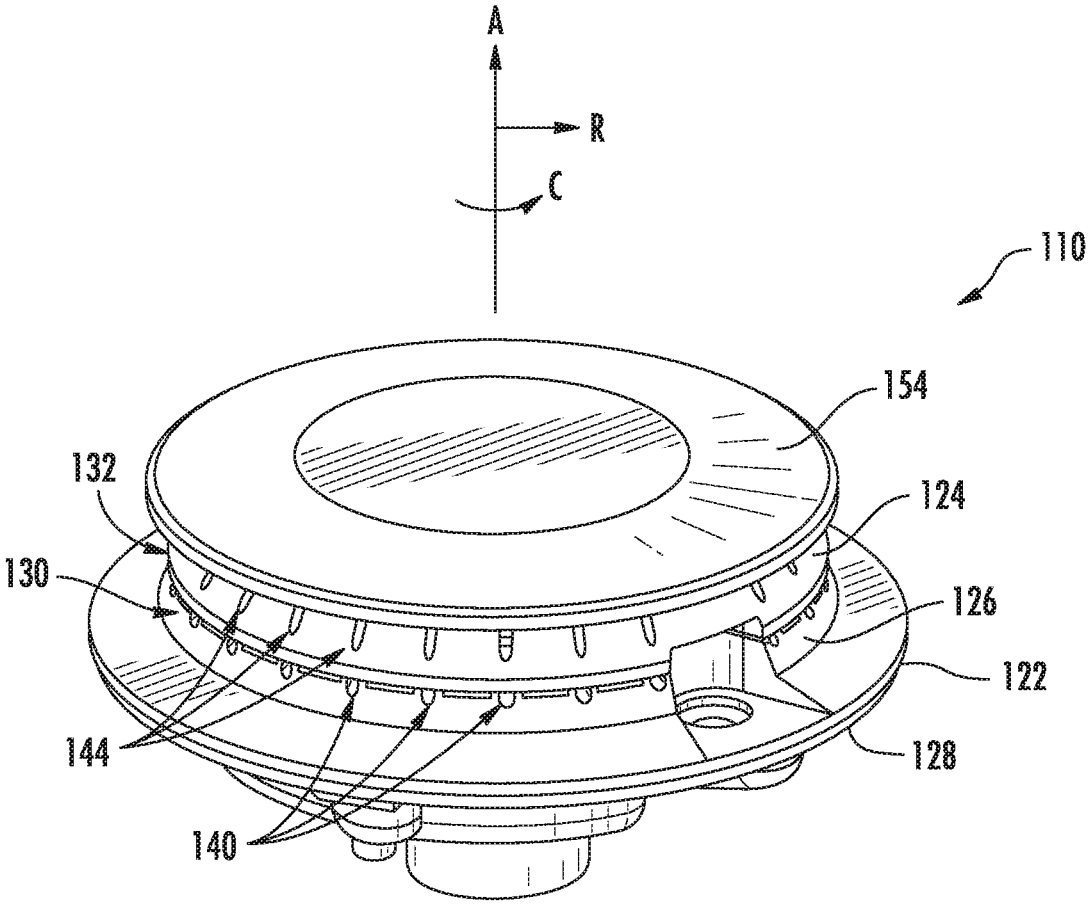
FIG. 2 provides a perspective view of a gas burner assembly of the exemplary cooktop appliance of FIG. 1 according to an exemplary embodiment of the present subject matter.
Figure 3:
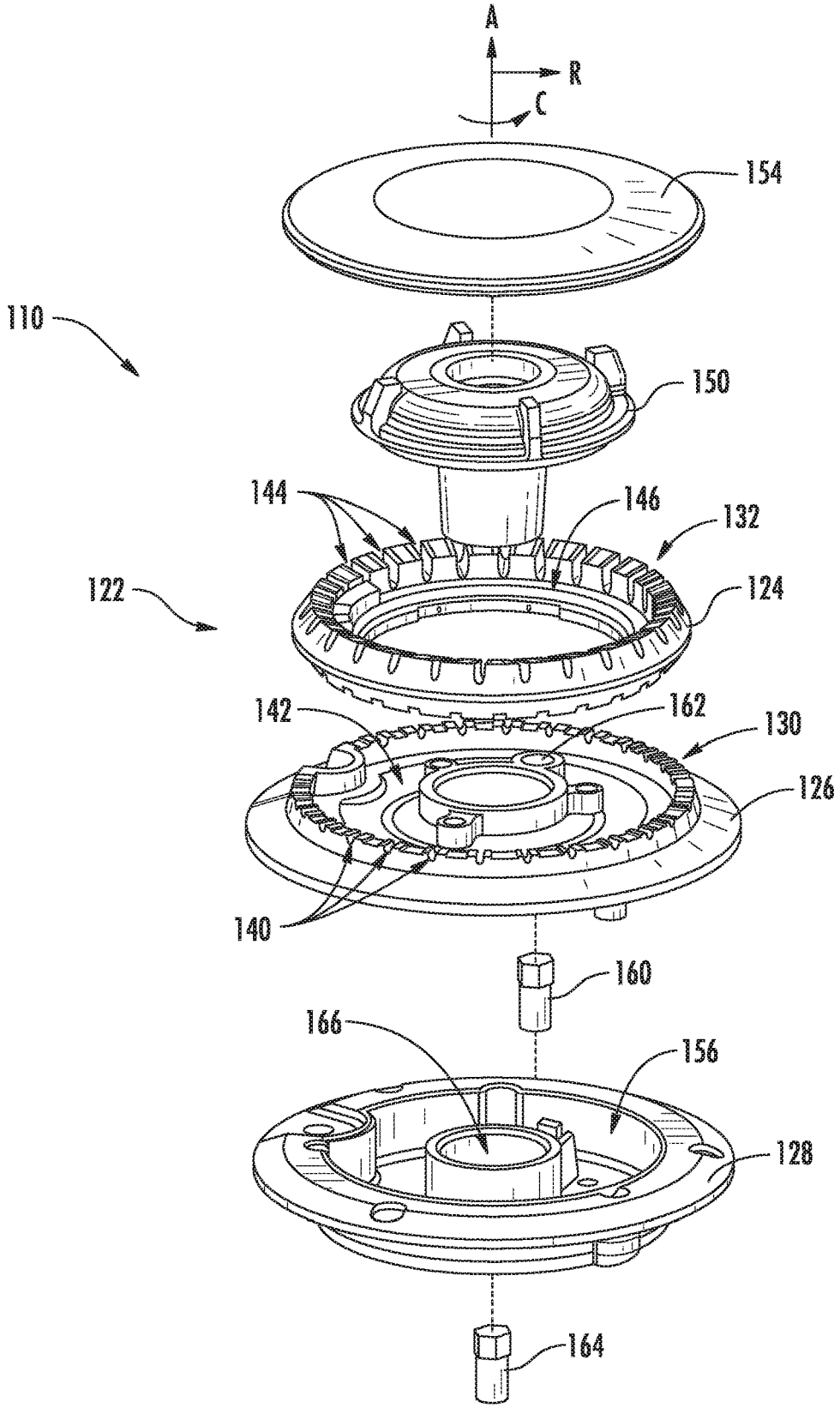
FIG. 3 provides an exploded perspective view of the exemplary gas burner assembly of FIG. 2.
Figure 4:
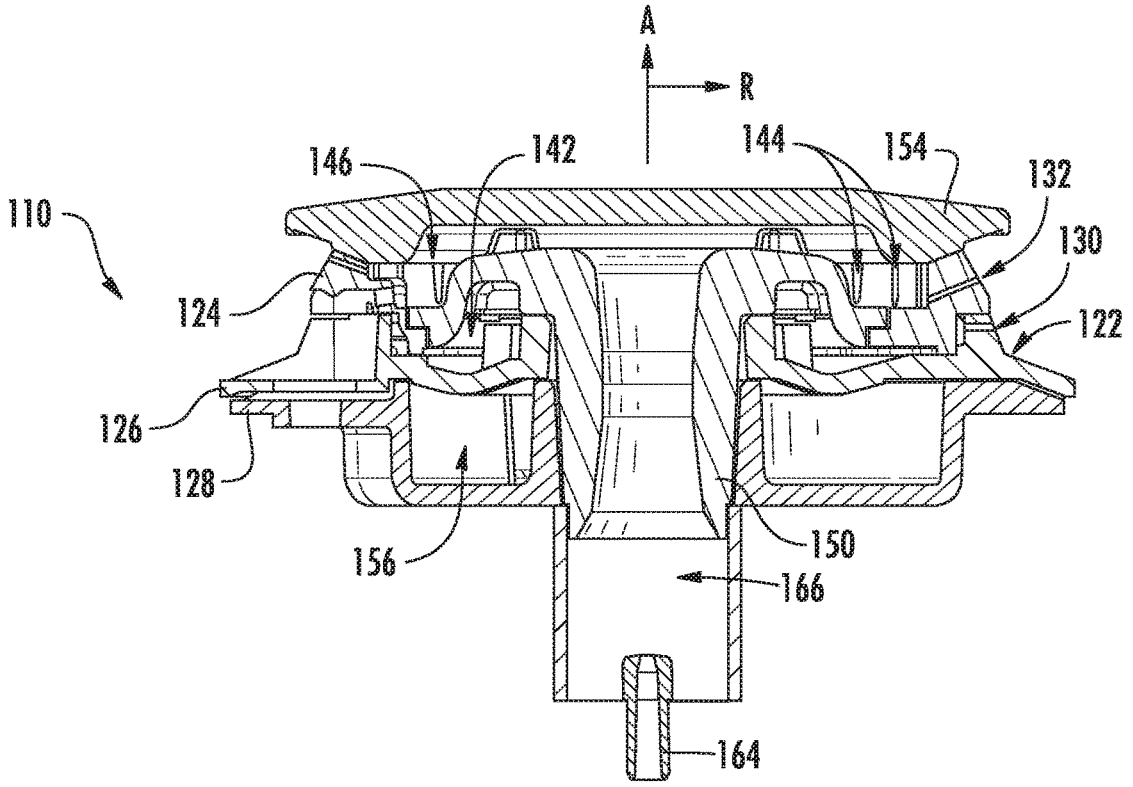
FIG. 4 provides a cross sectional view of the exemplary gas burner assembly of FIG. 2.
Figure 5:
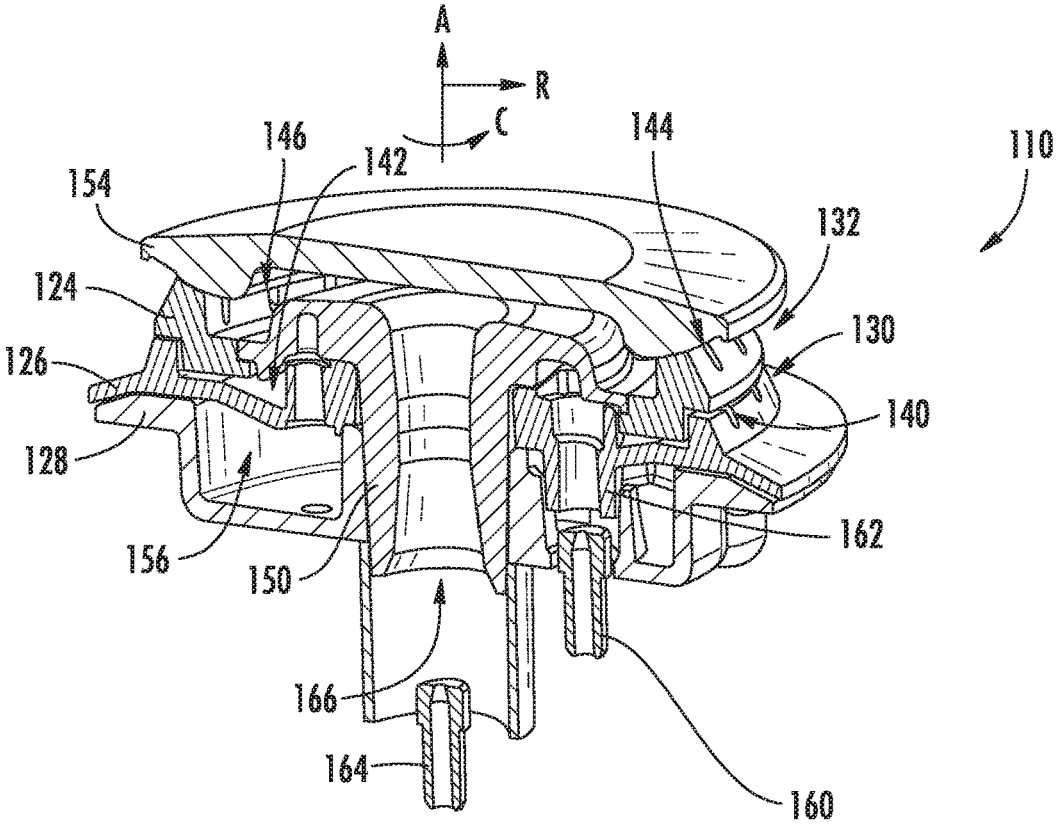
FIG. 5 provides another cross sectional view of the exemplary gas burner assembly of FIG. 2.

FIG. 2 is a perspective view of gas burner assembly 110. FIG. 3 is an exploded view of gas burner assembly 110. FIGS. 4 and 5 are cross sectional views of gas burner assembly 110. As an example, gas burner assembly 110 may be used in cooktop appliance 100 (FIG. 1) as one of heating elements 104. Gas burner assembly 110 generally defines an axial direction A, a radial direction R, and a circumferential direction C. When gas burner assembly 100 is installed in cooktop appliance 100, axial direction A generally corresponds with a vertical direction defined by cooktop appliance 100. However, it will be understood that, while described in greater detail below in the context of cooktop appliance 100, gas burner assembly 110 may be used in or with any suitable appliance in alternative example embodiments.

As may be seen in FIGS. 2 through 5, gas burner assembly 110 includes one or more burner bodies 122, which may include for example, a first burner body 124, a second burner body 126, and a third burner body 128. Burner bodies 122 generally define a first burner ring or stage 130 (e.g., an outer burner) and a second burner ring or stage 132 (e.g., an inner burner). More specifically, first burner stage 130 generally includes a first plurality of flame ports 140 and a first fuel chamber 142 which are defined by first burner body 124 and second burner body 126. Similarly, second burner stage 132 generally includes a second plurality of flame ports 144 and a second fuel chamber 146 which are defined at least in part by first burner body 124.

Gas burner assembly 110 may also include an air duct 150 and a cap 154. First plurality of flame ports 140 may be defined on second burner body 126, e.g., at a circular outer wall of second burner body 126. Similarly, second plurality of flame ports 144 may be defined on first burner body 124, e.g., at a circular outer wall of first burner body 124. Second fuel chamber 146 may be defined by inner surfaces of cap 154, air duct 150, and first burner body 124. First fuel chamber 142 may be defined by inner surfaces of air duct 150, first burner body 124, and second burner body 126. First fuel chamber 142 is separate or independent from second fuel chamber 146 within gas burner assembly 110. Thus, first fuel chamber 142 is not in flow communication with second fuel chamber 146 within gas burner assembly 110. In addition, an air chamber 156 may be defined by second burner body 126 and third burner body 128.

As may be seen in FIGS. 2 through 4, first plurality of flame ports 140 may be positioned concentric with second plurality of flame ports 144. Further, first plurality of flame ports 140 (and first burner stage 130) may be positioned below second plurality of flame ports 144 (and second burner stage 132). Such positioning of first burner stage 130 relative to second burner stage 132 may improve combustion of gaseous fuel when both stages 130, 132 are ignited. For example, flames at first burner stage 130 may assist with lighting gaseous fuel at second burner stage 132 due to the position of first burner stage 130 below second burner stage 132.

According to the exemplary illustrated embodiment, first burner stage 130 and second burner stage 132 are normally aspirated burners that rely on the energy available in the form of pressure from the fuel supplied to the gas burner to entrain air for combustion. In this regard, for example, as best shown in FIGS. 3 and 5, a first orifice 160 is positioned at, e.g., directly below and/or concentric with, a Venturi inlet passage 162 on second burner body 126. Venturi inlet passage 162 is in fluid communication with first fuel chamber 142. Thus, gaseous fuel from first orifice 160 may flow into first fuel chamber 142 through Venturi inlet passage 162. From first fuel chamber 142, the mixture of gaseous fuel and air may flow through and be combusted at first plurality of flame ports 140. Thus, first plurality of flame ports 140 are in fluid communication with first fuel chamber 142 such that the mixture of gaseous fuel and air within first fuel chamber 142 is flowable through first plurality of flame ports 140. Venturi inlet passage 162 assists with naturally aspirating first burner stage 130. For example, Venturi inlet passage 162 may increase a speed and/or decrease a pressure of gaseous fuel flowing from first orifice 160 such that Venturi inlet passage 162 entrains air from air chamber 156 into Venturi inlet passage 162.

Similarly, for example, as best shown in FIGS. 3 through 5, a second orifice 164 is positioned at, e.g., directly below and/or concentric with, a second stage inlet passage 166 defined by third burner body 128. Second stage inlet passage 166 is in fluid communication with second fuel chamber 146 such that gaseous fuel from second orifice 164 may flow into second fuel chamber 146 through second stage inlet passage 166. From second fuel chamber 146, the mixture of gaseous fuel and air may flow through and be combusted at second plurality of flame ports 144. Thus, second plurality of flame ports 144 are in fluid communication with second fuel chamber 146 such that the mixture of gaseous fuel and air within second fuel chamber 146 is flowable through second plurality of flame ports 144. Second stage inlet passage 166 may define any suitable shape or profile, e.g., similar to Venturi inlet passage 162, to assist with naturally aspirating second burner stage 132.

Referring again to FIG. 1, cooktop appliance 100 includes a user interface panel or control panel 170 located within convenient reach of a user of cooktop appliance 100. For this exemplary embodiment, control panel 170 includes control knobs 172 that are each associated with one of heating elements 104. Control knobs 172 allow the user to activate each heating element 104 and regulate the amount of heat input each heating element 104 provides to a cooking utensil located thereon, as described in more detail below.

Although cooktop appliance 100 is illustrated as including control knobs 172 for controlling gas burner assemblies 110, it should be understood that control knobs 172 and the configuration of cooktop appliance 100 shown in FIG. 1 is provided by way of example only. More specifically, control panel 170 may include various input components, such as one or more of a variety of touch-type controls, electrical, mechanical or electro-mechanical input devices including rotary dials, push buttons, and touch pads. Control panel 170 may also be provided with one or more graphical display devices, such as a digital or analog display device designed to provide operational feedback to a user. For example, as illustrated in FIG. 1, cooktop appliance 100 may include a digital display and touch screen interface 174 for displaying information and receiving inputs.

According to the illustrated embodiment, control knobs 172 are located within control panel 170 of cooktop appliance 100. However, it should be appreciated that this location is used only for the purpose of explanation, and that other locations and configurations of control panel 170 and control knobs 172 are possible and within the scope of the present subject matter. Indeed, according to alternative embodiments, control knobs 172 may instead be located directly on top panel 102 or elsewhere on cooktop appliance 100, e.g., on a backsplash, front bezel, or any other suitable surface of cooktop appliance 100.

Operation of cooktop appliance 100 is controlled by electromechanical switches or by a controller or processing device 178 (FIG. 1) that is operatively coupled to control panel 170 for user manipulation, e.g., to control the operation of heating elements 104. In response to user manipulation of control panel 170 (e.g., via control knobs 172 and/or touch screen interface 174), controller 178 operates the various components of cooktop appliance 100 to execute selected instructions, commands, or other features. Controller 178 may be positioned in a variety of locations throughout cooktop appliance 100. In the illustrated embodiment, the controller 178 may be located within a control panel area 170 as shown in FIG. 1. Control panel 170 and other components of cooktop appliance 100 may be in communication with controller 178 via one or more signal lines or shared communication busses.

Controller 178 may include one or more memory devices and one or more microprocessors, such as general or special purpose microprocessors operable to execute programming instructions or micro-control code associated with appliance operation cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 178 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 6:
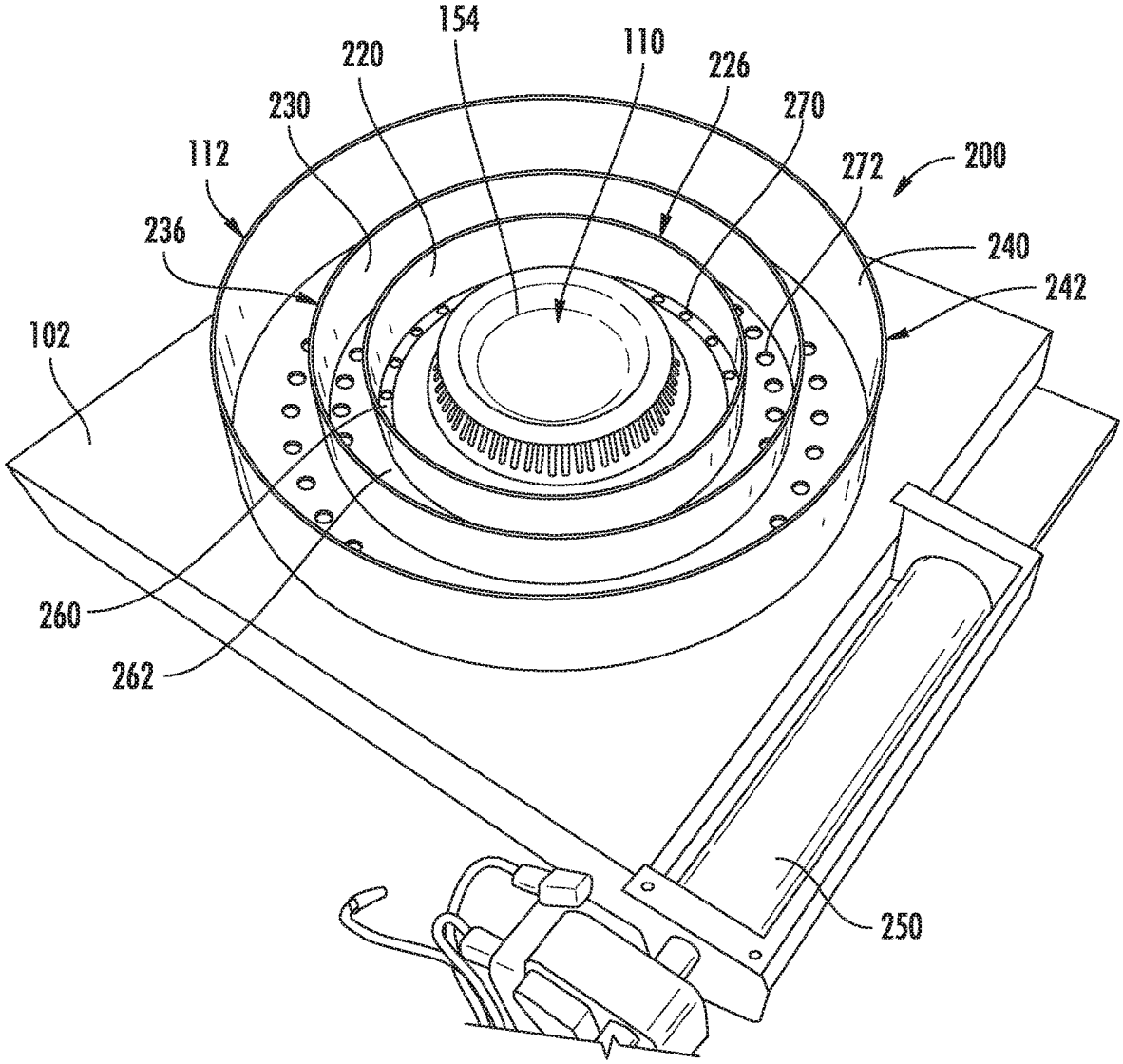
FIG. 6 depicts an exhaust gas collection system for use with the exemplary gas burner assembly of FIG. 2 according to an example embodiment of the present subject matter.
Figure 7:
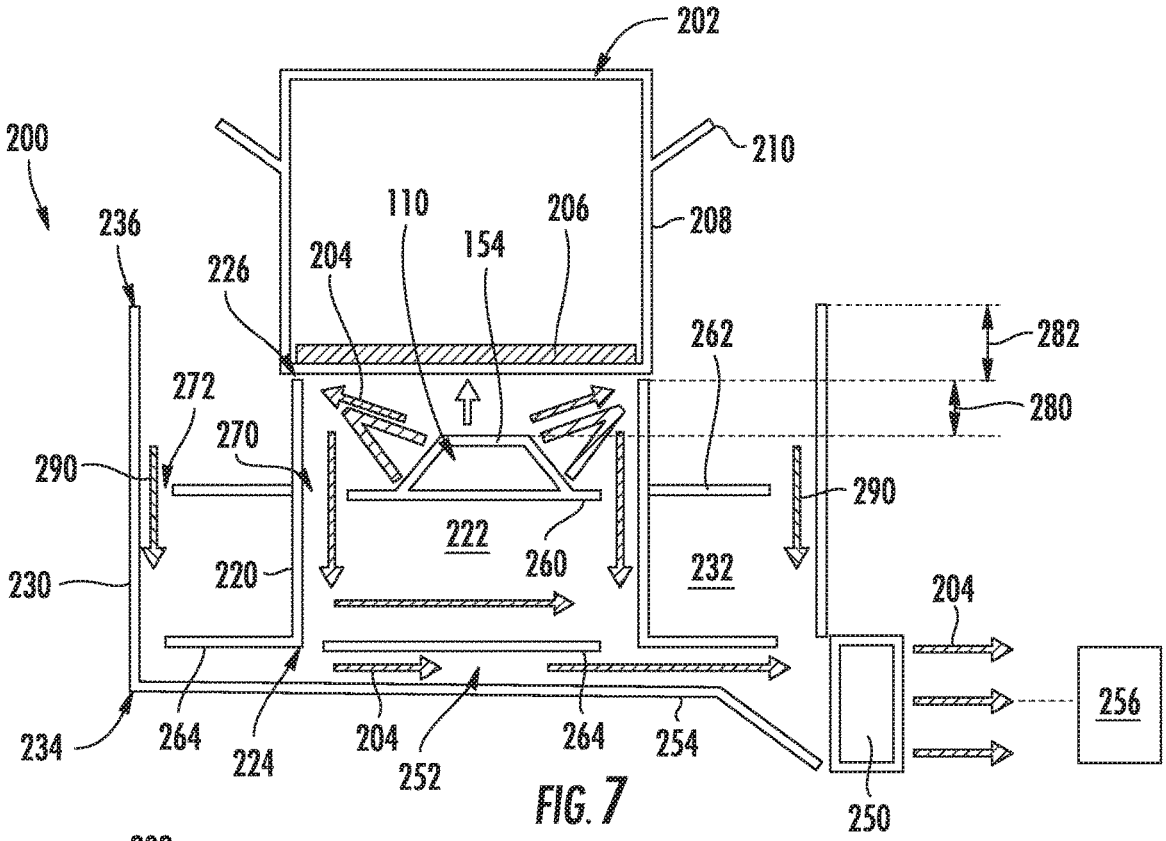
FIG. 7 provides a side, schematic view of the exemplary exhaust gas collection system of FIG. 6 as it collects exhaust gases while heating a small utensil according to an example embodiment of the present subject matter.
Figure 8:
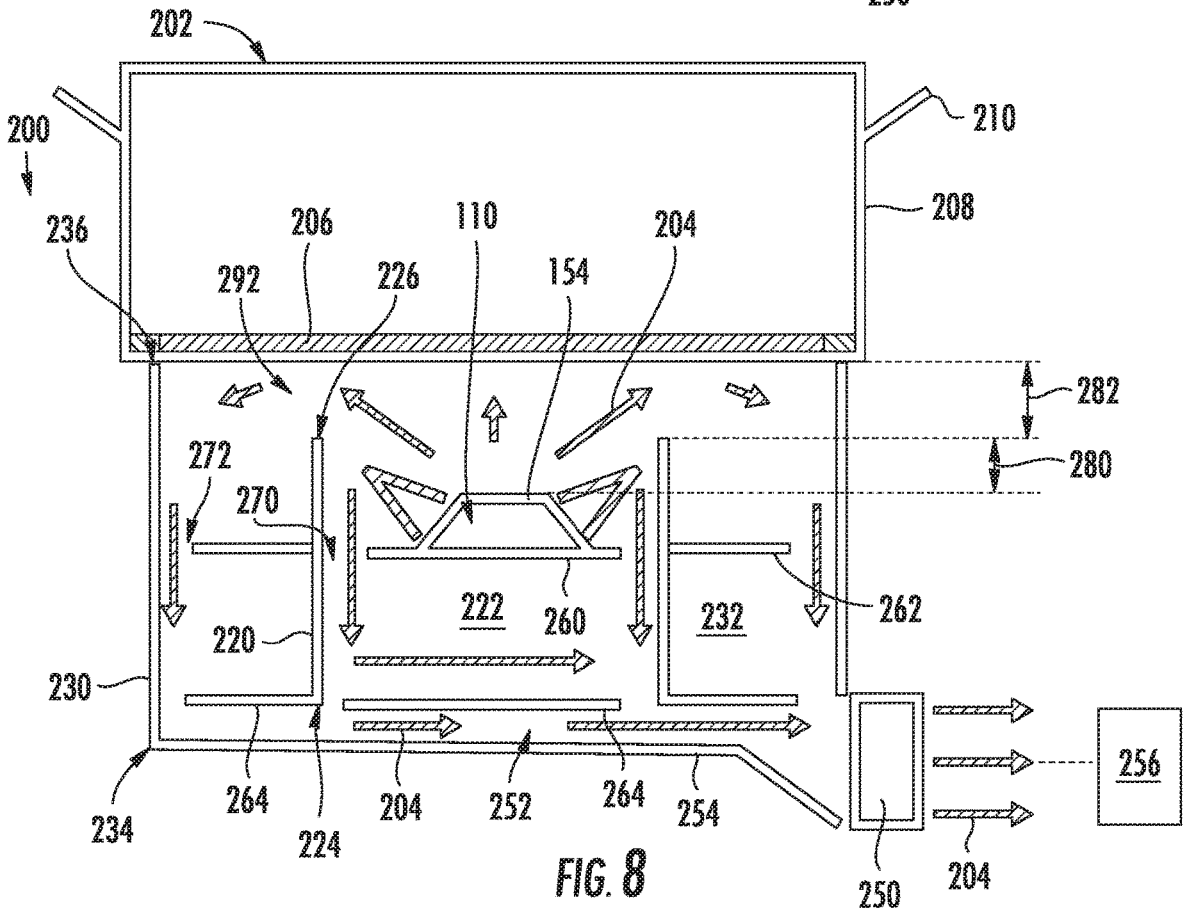
FIG. 8 provides a side, schematic view of the exemplary exhaust gas collection system of FIG. 6 as it collects exhaust gases while heating a large utensil according to an example embodiment of the present subject matter.

Referring now to FIGS. 6 through 8, an exhaust gas collection system 200 that may be used with gas burner assembly 110 for collecting exhaust gases and flames will be described according to an exemplary embodiment. Although gas burner assembly 110 and cooktop appliance 100 are used below for the purpose of explaining aspects of exhaust gas collection system 200, it should be appreciated that the present subject matter may apply to any other suitable burner assembly in any other consumer or commercial cooking appliance. For example, exhaust gas collection system 200 may be used on other types of burners and in other cooking appliances, such as ranges or oven appliances. Cooktop appliance 100 and gas burner assembly 110 are used in the discussion below only for the purpose of explanation, and such use is not intended to limit the scope of the present disclosure in any manner. In addition, variations and modification may be made to exhaust gas collection system 200 while remaining within the scope of the present subject matter.

During operation of gas burner assembly 110, a flow of gaseous fuel is combusted to produce heat for heating a cooking utensil 202. In this regard, gas burner assembly 110 is positioned below cooking utensil 202 and a flow of exhaust gas (identified herein as 204) travels over a bottom surface 206 of the cooking utensil to heat the cooking utensil. As used herein, "exhaust gas" may be used to refer to any product of the combustion process generated by gas burner assembly 110, such as combustion gases, heat, flames, etc. Notably, conventional cooktop appliance support cooking utensils 202 using grates positioned above the gas burner assemblies. As a result, the flow of exhaust gas 204 flows around bottom surface 206 and up a sidewall 208 of cooking utensil 202. As a result, sidewall 208 and handles 210 of cooking utensils 202 frequently become too hot to hold and external devices such as thermometers cannot be mounted on cooking utensil 202. Moreover, the flow of exhaust gas 204 may generate too much heat in the kitchen and may present safety issues, as described briefly above.

In general, exhaust gas collection system 200 includes a plurality of support rings that are positioned concentrically about gas burner assembly 110. Each of the plurality of support rings may be generally configured for supporting a cooking utensil having a specific size, e.g., a pot having a diameter equivalent to the diameter of the support ring. In addition, the support rings are spaced apart from each other along the radial direction R such that gas flow plenums are defined between adjacent support rings and/or gas burner assembly 110. Furthermore, a means for urging a flow of exhaust gas out of each of the gas flow plenums is provided, e.g., such as an exhaust fan fluidly coupled to each of the gas flow plenums, e.g., at a bottom of exhaust gas collection system 200. Although one exemplary configuration of exhaust gas collection system 200 is described below, it should be appreciated that variations and modifications may be made to exhaust gas collection system 200 while remaining within the scope of the present subject matter.

Referring now specifically to the figures, exhaust gas collection system 200 includes a first support ring 220 that is positioned around gas burner assembly 110. In this regard, first support ring 220 is essentially a thin-walled hollow cylinder that is spaced apart from gas burner assembly 110 along the radial direction R. Thus, first support ring 220 may generally define a first gas plenum 222 within the hollow region within first support ring 220. In addition, first support ring 220 may extend substantially along the axial direction A between a bottom wall 224 and a first support surface 226. Notably, first support surface 226 is generally configured for supporting a cooking utensil 202 which has a diameter substantially equivalent to the diameter of first support ring 220. It should be appreciated that as used herein, terms of approximation, such as "approximately," "substantially," or "about," refer to being within a ten percent margin of error. As best shown in FIG. 7, first support surface 226 of first support ring 220 is positioned above cap 154 of gas burner assembly 110 along the axial direction A. In this manner, the flow of exhaust gas 204 may rise vertically or along the axial direction A to heat bottom surface 206 of cooking utensil 202 and spread outward along the radial direction R before being drawn back downward through first gas plenum 222.

As illustrated, exhaust gas collection system 200 further includes a second support ring 230 that is positioned around first support ring 220. In addition, second support ring 230 is spaced apart from first support ring 220 along the radial direction R. Thus, first support ring 220 and second support ring 230 generally define a second gas plenum 232 therebetween. Second support ring 230 generally extends along the axial direction A between a bottom wall 234 and a second support surface 236. Second support ring 230 may be the same as first support ring 220 except that it has a larger diameter and taller height. In this regard, for example, second support ring 230 may be configured for supporting a cooking utensil 202 that has a larger diameter than that supported by first support ring 220.

According to the illustrated embodiment, support rings are generally concentric and positioned around gas burner assembly 110. For example, first support ring 220 and second support ring 230 share a center that coincides with a central axis of gas burner assembly 110. However, it should be appreciated that according to alternative embodiments, support rings need not be concentric. Moreover, although support rings are all illustrated as having a circular profile, other suitable profiles may be used while remaining within the scope of the present subject matter.

In addition, although exhaust gas collection system 200 described in FIGS. 7 and 8 has two support rings (i.e., first support ring 220 and second support ring 230), alternative embodiments could include any suitable number of support rings having any suitable size, shape, and position. For example, as illustrated in FIG. 6, exhaust gas collection system 200 includes three support rings, e.g., such that it may support cooking utensils 202 having three different sizes. Specifically, as shown in FIG. 6, exhaust gas collection system 200 may include a third support ring 240 which defines a third gas plenum (not shown) and a third support surface 242.

Referring still to FIGS. 6 through 8, exhaust gas collection system 200 further includes an exhaust fan 250 which is fluidly coupled to the gas plenums defined by the plurality of support rings for drawing in and discharging the flow of exhaust gas 204 generated by gas burner assembly 110. Specifically, exhaust fan 250 is fluidly coupled to first gas plenum 222 and second gas plenum 232 by an exhaust conduit 252 that extends between and fluidly couples exhaust fan 250 thereto. Specifically, as illustrated, exhaust conduit 252 may be defined at least in part by a lower wall 254 and may extend substantially along a horizontal direction (e.g., within a plane perpendicular to the axial direction A) below bottom wall 224 of first support ring 220. Exhaust conduit 252 can be a single conduit such as a pipe that extends between the various gas plenums, or could alternatively be a horizontally extending plenum positioned below first support ring 220 and second support ring 230. Other means for collecting and exhausting the flow of exhaust gas 204 are possible and within scope of the present subject matter.

According to the illustrated exemplary embodiment, exhaust fan 250 is a centrifugal fan positioned just below top panel 102. However, it should be appreciated that according to alternative embodiments, exhaust fan 250 may be any suitable fan type (e.g., such as an axial fan) and may be positioned at any other suitable location. In addition, according to an exemplary embodiment, exhaust fan 250 is a variable speed fan and may rotate at different rotational speeds to generate different air flow rates depending on the application or the operation of gas burner assembly 110.

Exhaust fan 250 is generally configured for drawing in the flow of exhaust gas 204 and discharging it at a location more suitable than immediately adjacent gas burner assembly 110. For example according to the illustrated embodiment, exhaust fan 250 and exhaust conduit 252 may be in fluid communication with a discharge vent 256. For example, discharge vent 256 (FIG. 1) may be a rear discharge vent defined in top panel 102 of cooktop appliance 100, a kitchen exhaust hood, or an outdoor vent for discharging the flow of exhaust gas 204.

Notably, the size, spacing, and orientation of support rings 220, 230 and other parts of exhaust gas collection system 200 may affect the flow of exhaust gas 204 throughout the system. In addition, exhaust gas collection system 200 may define various other features for directing the flow of exhaust gas 204 or otherwise strategically restricting the flow of exhaust gas 204 through specific regions of exhaust gas collection system 200 to achieve the desired flow rates and paths. Several of these flow regulation features will be described below according to an exemplary embodiment. However, it should be appreciated that the features described below are not intended to limit the scope of subject matter in any way.

As shown in FIGS. 6 through 8, exhaust gas collection system 200 may include baffles positioned within various gas plenums in order to restrict or direct the flow of exhaust gas 204. In this regard, for example, a first restriction baffle 260 is positioned within the first gas plenum 222 and a second restriction baffle 262 is positioned within second gas plenum 232 to strategically restrict the flow of exhaust gas 204 through these plenums 222, 232. In addition, exhaust gas collection system 200 may further include lower baffles 264 positioned within first gas plenum 222 and/or second gas plenum 232 to provide additional restriction to the flow of exhaust gas 204.

Notably, any suitable number and type of baffles 260-264 may be used to restrict the flow of exhaust gas 204 any suitable manner. For example, according to an exemplary embodiment, these baffles may extend substantially along the horizontal direction to a position proximate an adjacent support ring. According to the illustrated embodiment, first restriction baffle 260 defines a first plurality of apertures 270 spaced around first restriction baffle 260 along the circumferential direction C. Similarly, second restriction baffle 262 defines a second plurality of apertures 272 spaced around second restriction baffle 262 along the circumferential direction C.

It should be appreciated that the number, size, and spacing of apertures 270, 272 control how the flow of exhaust gas 204 moves within exhaust system 200 depending on the size of cooking utensil 202 positioned thereon. In order to achieve a substantially equivalent flow rate through each of first gas plenum 222 and second gas plenum 232, apertures 270, 272 may generally define a similar flow area. Specifically, the first plurality of apertures 270 may generally define a first collective flow area (i.e., equivalent to a sum of the cross sectional area of each of the first plurality of apertures 270). Similarly, the second plurality of apertures 272 may generally define a second collective flow area. According to an exemplary embodiment, the first collective flow area and the second collective flow area are substantially equivalent. According to still other embodiments, the first collective flow area may be larger than or smaller than the second collective flow area to achieve any suitable flow pattern of exhaust gas 204.

Notably, exhaust gas collection system 200 should facilitate the use of cooking utensils 202 having various diameters without requiring any adjustments to the support rings. Therefore, first support ring 220 and second support ring 230 extend to two different heights above the top panel 102. Specifically, second support surface 236 is positioned vertically above first support surface 226. More generally, for exhaust gas collection systems 200 including more than two support rings, the support rings increase in height as they move radially outward from gas burner assembly 110. As best illustrated in FIGS. 7 and 8, such a configuration permits gas burner assembly 110 to heat the entire bottom surface 206 of a given cooking utensil 202 without permitting the flow of exhaust gas 204 to escape around cooking utensil 202.

Specifically, according to one exemplary embodiment, a first height 280 is defined between cap 154 of gas burner assembly 110 and first support surface 226 along the axial direction A. In addition, a second height 282 is defined between first support surface 226 and second support surface 236 along the axial direction A. According to an exemplary embodiment, second height 282 is greater than or equal to first height 280. According to still another embodiment, second height 282 is approximately twice first height 280. Notably, according to alternative embodiments, first height 280 and second height 282 may be adjusted in any suitable manner to achieve the desired flow rate of exhaust gases 204 when different size cooking utensils 202 are positioned on top of exhaust gas collection system 200.

During operation, exhaust gas collection system 200 may effectively contain substantially all of the flow of exhaust gas 204 without necessitating a very large exhaust fan 250. In this regard, when a small cooking utensil 202 is used (see FIG. 7), bottom surface 206 essentially forms a seal to prevent large amounts of the flow of exhaust gas 204 from passing between cooking utensil 202 and first support ring 220. Thus, substantially all of the flow of exhaust gas 204 may be drawn back down through the first gas plenum 222, into exhaust conduit 252, and urged out discharge vent 256 by exhaust fan 250. Notably, in such a configuration, exhaust fan 250 may also pull in some ambient air 290, but due to the restriction achieved by second restriction baffle 262 and lower baffle 264, a large capacity exhaust fan 250 is still not required.

By contrast, when a large cooking utensil 202 is used (see FIG. 8), bottom surface 206 forms a partial seal with second support ring 230 to prevent the flow of exhaust gas 204 from passing between cooking utensil 202 and second support ring 230. In addition, due to the height differences between first support ring 220 and second support ring 230, a flow gap 292 is defined between bottom surface 206 of cooking utensil 202 and first support surface 226 along the axial direction A to permit the flow of exhaust gas 204 to circulate both through first gas plenum 222 and second gas plenum 232. In this manner, the entire bottom surface 206 cooking utensil 202 is thoroughly and evenly heated while substantially all of the flow of exhaust gas 204 is circulated back through exhaust conduit 252 and discharge out discharge vent 256.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance comprising:

a top panel;

a gas burner assembly positioned at the top panel and defining an axial direction, the gas burner assembly comprising a cap and being configured for combusting a flow of gas and generating a flow of exhaust gas; and an exhaust gas collection system comprising:

a first support ring positioned around the gas burner assembly, the first support ring defining a first gas plenum and a first support surface that is positioned above the cap of the gas burner assembly along the axial direction, the first support surface being configured for supporting a first cooking utensil having a first size;

a second support ring positioned around and spaced apart from the first support ring to define a second gas plenum, the second support ring defining a second support surface that is positioned above the first support surface along the axial direction, the second support surface being configured for supporting a second cooking utensil having a second size; and an exhaust fan fluidly coupled to the first gas plenum and the second gas plenum for collecting the flow of exhaust gas.

2. The cooktop appliance of claim 1, wherein the first support ring and the second support ring are concentric.

3. The cooktop appliance of claim 1, wherein the exhaust gas collection system further comprises:

a third support ring positioned around and spaced apart from the second support ring to define a third gas plenum, the third support ring defining a third support surface that is positioned above the second support surface along the axial direction.

4. The cooktop appliance of claim 1, wherein the exhaust gas collection system further comprises:

an exhaust conduit that extends between and fluidly couples the exhaust fan to the first gas plenum and the second gas plenum, the exhaust conduit extending substantially along a horizontal direction below a bottom wall of the first support ring.

5. The cooktop appliance of claim 1, wherein the exhaust gas collection system further comprises:

a first restriction baffle positioned within the first gas plenum to restrict the flow of exhaust gas through the first gas plenum; and a second restriction baffle positioned within the second gas plenum to restrict the flow of exhaust gas through the second gas plenum.

6. The cooktop appliance of claim 5, further comprising one or more lower baffles positioned within at least one of the first gas plenum and the second gas plenum for further restricting the flow of exhaust gas.

7. The cooktop appliance of claim 5, wherein the first restriction baffle defines a first plurality of apertures spaced circumferentially around the first restriction baffle and the second restriction baffle defines a second plurality of apertures spaced circumferentially around the second restriction baffle.

8. The cooktop appliance of claim 7, wherein the first plurality of apertures define a first collective flow area and the second plurality of apertures define a second collective flow area, wherein the first collective flow area and the second collective flow area are substantially equivalent.

9. The cooktop appliance of claim 1, wherein the exhaust fan is fluidly coupled to a rear discharge vent, an exhaust hood, or an outdoor vent for discharging the flow of exhaust gas.

10. The cooktop appliance of claim 1, wherein a first height is defined between the cap of the gas burner assembly and the first support surface along the axial direction and a second height is defined between the first support surface and the second support surface along the axial direction, the second height being greater than the first height.

11. The cooktop appliance of claim 10, wherein the second height is approximately twice the first height.

12. An exhaust gas collection system for a gas burner assembly, the gas burner assembly being configured for combusting fuel to generate a flow of exhaust gas, the exhaust gas collection system comprising:

a first support ring positioned around the gas burner assembly, the first support ring defining a first gas plenum and a first support surface that is positioned above a cap of the gas burner assembly along an axial direction, the first support surface being configured for supporting a first cooking utensil having a first size;

a second support ring positioned around and spaced apart from the first support ring to define a second gas plenum, the second support ring defining a second support surface that is positioned above the first support surface along the axial direction, the second support surface being configured for supporting a second cooking utensil having a second size; and an exhaust fan fluidly coupled to the first gas plenum and the second gas plenum for collecting the flow of exhaust gas.

13. The exhaust gas collection system of claim 12, wherein the first support ring and the second support ring are concentric.

14. The exhaust gas collection system of claim 12, further comprising:

a third support ring positioned around and spaced apart from the second support ring to define a third gas plenum, the third support ring defining a third support surface that is positioned above the second support surface along the axial direction.

15. The exhaust gas collection system of claim 12, further comprising:

an exhaust conduit that extends between and fluidly couples the exhaust fan to the first gas plenum and the second gas plenum, the exhaust conduit extending substantially along a horizontal direction below a bottom wall of the first support ring.

16. The exhaust gas collection system of claim 12, further comprising:

a first restriction baffle positioned within the first gas plenum to restrict the flow of exhaust gas through the first gas plenum; and a second restriction baffle positioned within the second gas plenum to restrict the flow of exhaust gas through the second gas plenum.

17. The exhaust gas collection system of claim 16, wherein the first restriction baffle defines a first plurality of apertures spaced circumferentially around the first restriction baffle and the second restriction baffle defines a second plurality of apertures spaced circumferentially around the second restriction baffle.

18. The exhaust gas collection system of claim 17, wherein the first plurality of apertures define a first collective flow area and the second plurality of apertures define a second collective flow area, wherein the first collective flow area and the second collective flow area are substantially equivalent.

19. The exhaust gas collection system of claim 12, wherein the exhaust fan is fluidly coupled to a rear discharge vent, an exhaust hood, or an outdoor vent for discharging the flow of exhaust gas.

20. The exhaust gas collection system of claim 12, wherein a first height is defined between the cap of the gas burner assembly and the first support surface along the axial direction and a second height is defined between the first support surface and the second support surface along the axial direction, the second height being greater than the first height.

* * * * *